US011008752B1

(12) United States Patent
Castro

(10) Patent No.: US 11,008,752 B1
(45) Date of Patent: May 18, 2021

(54) INSULATING SUPERBLOCKS FOR CONSTRUCTING MODULAR SUPERBLOCK ASSEMBLIES

(71) Applicant: Juan Diego Castro, Tucson, AZ (US)

(72) Inventor: Juan Diego Castro, Tucson, AZ (US)

( * ) Notice: Subject to any disclaimer, the term of this patent is extended or adjusted under 35 U.S.C. 154(b) by 0 days.

(21) Appl. No.: 17/063,526

(22) Filed: Oct. 5, 2020

(51) Int. Cl.
*E04B 2/46* (2006.01)
*E04B 2/02* (2006.01)

(52) U.S. Cl.
CPC ..... *E04B 2/46* (2013.01); *E04B 2002/0206* (2013.01); *E04B 2002/0226* (2013.01)

(58) Field of Classification Search
CPC ..... E04B 2/46; E04B 2002/0206; E04B 2002/0226; E04B 2002/0243
USPC ..... 52/223.7
See application file for complete search history.

(56) References Cited

U.S. PATENT DOCUMENTS 690,811 A * 1/1902 Waller ..... E04B 2/06 52/592.6
839,592 A * 12/1906 Jackson ..... E04B 1/24 52/781.3
2,392,551 A * 1/1946 Roe ..... E04B 2/08 52/586.2
3,204,381 A * 9/1965 Perreton ..... E04B 2/46 52/309.12
3,510,979 A * 5/1970 Fischer ..... E04B 2/08 446/102
3,686,873 A * 8/1972 Vidal ..... E02D 29/0241 405/262
3,710,527 A * 1/1973 Farebrother ..... E04B 1/04 52/236.7
3,803,788 A * 4/1974 Artmann ..... E04C 2/06 52/417
4,380,887 A * 4/1983 Lee ..... B28B 7/162 52/405.1
4,485,604 A * 12/1984 Palamara ..... E04B 2/54 52/436
4,557,094 A * 12/1985 Beliveau ..... E04B 2/18 52/405.4
4,565,043 A * 1/1986 Mazzarese ..... E04B 2/26 52/592.6
4,905,439 A * 3/1990 Filteau ..... E04C 1/40 106/672
4,939,881 A * 7/1990 Reinle ..... E04B 2/10 52/565

(Continued)

*Primary Examiner* — Brian D Mattei
*Assistant Examiner* — Joseph J. Sadlon

(57) ABSTRACT

A modular superblock assembly includes interconnectable and stackable insulating concrete forms that each comprise a block body. The block body includes a central mounting hole, a first lateral recess, second lateral recess, first vertical recess, second vertical recess, and aligning features. The first lateral recess traverses a first lateral side of the block body. The second lateral recess traverses a second lateral side of the block body. The first vertical recess traverses a first vertical side of the block body. The second vertical recess traverses a second vertical side of the block body. The central mounting hole traverses the lateral recesses and is oriented perpendicular thereto. The plurality of aligning features includes aligning plates and slots. Each aligning plate is partially embedded in a first surface of the block body and positioned proximate to the first lateral recess. Aligning slots are positioned on the first surface.

1 Claim, 10 Drawing Sheets

(56) References Cited

U.S. PATENT DOCUMENTS 5,596,853 A * 1/1997 Blaney ..... E04C 2/044 52/223.7
5,709,060 A * 1/1998 Vaughan ..... E04B 2/54 52/426
5,802,797 A * 9/1998 Storer-Folt ..... E04B 2/52 52/604
6,010,279 A * 1/2000 Taylor-Smith ..... E04B 2/18 405/286
6,122,880 A * 9/2000 Kolb ..... E04C 1/40 52/592.6
6,223,493 B1 * 5/2001 Rugged ..... E04B 2/16 52/592.6
6,244,009 B1 * 6/2001 Cerrato ..... E04B 2/08 52/223.7
6,345,473 B1 * 2/2002 Fink ..... E04B 1/215 52/127.7
6,389,758 B1 * 5/2002 Martin, Jr. ..... E04C 1/40 52/125.2
6,450,853 B1 * 9/2002 Larws ..... A63H 33/101 446/122
6,606,835 B1 * 8/2003 Bilka ..... E04B 2/06 52/311.1
6,735,913 B2 * 5/2004 Sanders ..... E04C 1/395 256/19
6,962,028 B2 * 11/2005 Banova ..... E04B 2/44 52/379
7,204,060 B2 * 4/2007 Hunt ..... E04C 2/049 52/284
7,748,192 B2 * 7/2010 Ryder ..... E04C 5/168 52/569
7,802,410 B2 * 9/2010 Breaz ..... E04B 2/26 52/503
7,905,070 B2 * 3/2011 August ..... E04B 2/54 52/604
8,132,378 B2 * 3/2012 Rizzon ..... E04C 1/42 52/308
8,147,009 B1 * 4/2012 Rider ..... A47B 47/00 312/257.1
8,171,693 B2 * 5/2012 Banova ..... E04B 2/40 52/592.5
8,402,710 B2 * 3/2013 Cables ..... E04B 2/46 52/604
8,549,811 B2 * 10/2013 Dyson ..... E04B 2/46 52/604
8,671,634 B2 * 3/2014 Morcous ..... E04B 5/43 52/252
8,893,450 B2 * 11/2014 Zohar ..... E04B 1/02 52/606
9,021,762 B1 * 5/2015 DePalma ..... E04B 2/22 52/596
9,057,171 B2 * 6/2015 Ferraiolo ..... E02D 29/0241
9,127,449 B2 * 9/2015 Clear ..... E04B 2/24
9,206,598 B2 * 12/2015 Phillips ..... E04B 2/16
9,238,910 B2 * 1/2016 Jensen ..... E04B 2/54
9,435,118 B2 * 9/2016 Al-Salloum ..... E04B 2/46
9,574,317 B2 * 2/2017 MacDonald ..... E02D 3/10
9,683,368 B1 * 6/2017 Campagna ..... E04B 2/36
10,036,161 B1 * 7/2018 Roberts ..... E04B 2/22
10,094,110 B2 * 10/2018 Gomes ..... E04C 1/397
10,151,111 B1 * 12/2018 Porter ..... E04B 2/14
10,472,822 B1 * 11/2019 Castro ..... E04B 2/38
10,487,504 B1 * 11/2019 Nickerson ..... E04C 1/41
10,767,369 B2 * 9/2020 Ekster ..... B32B 5/028
2005/0034406 A1 * 2/2005 Walker ..... E04C 5/02 52/596
2014/0123583 A1 * 5/2014 Arriola Serrano ..... E04B 2/16 52/405.1
2014/0223848 A1 * 8/2014 Binhussain ..... E04C 1/40 52/309.17

* cited by examiner

INSULATING SUPERBLOCKS FOR CONSTRUCTING MODULAR SUPERBLOCK ASSEMBLIES

FIELD OF THE INVENTION

The present disclosure relates generally to construction materials. More specifically, the present disclosure describes insulating superblocks for constructing modular superblock assemblies. Moreover, the present invention relates to interlocking insulating construction blocks with the added support of aligning wedges providing structural integrity for drywall and trim installation, replacing large amounts of expensive reinforced concrete with low cost recycle insulation, reducing labor and material costs.

BACKGROUND OF THE INVENTION

Post and beam (interlinked vertical and horizontal supports) construction has been used for centuries in building construction and is known for its strength and longevity. Post and beam construction is one of the ancient methods of building and was used in Rome thousands of years ago. Post and beam construction is still used today. Timbers can be employed to erect post and beam support structures. Concrete forms can also be employed to erect concrete post and beam support structures.

Nearly half a century ago, petroleum derivative foam began to be used for insulation purposes in residential and commercial buildings. Often this foam was only sprayed inside the walls or under the roof for an additional measure of protection. As the use of this foam increased, insulating concrete forms (hereinafter referred to as "ICFs") were introduced. Currently, there are numerous varieties of methods, designs and types of petroleum derived ICFs that have evolved for building purposes. Unlike wood or steel forms, the ICFs becomes a permanent part of the building, providing insulation that contributes to energy efficiency, decreased noise, and a smaller environmental footprint overall.

Generally, presently available ICFs include interlockable modular units, such as foam blocks, made of polystyrene beads that are poured into a mold and are fused together by the use of steam. These foam blocks generally are largely hollow with cavities that allow for columns of concrete to be poured inside them. The blocks are stacked to create a wall, and concrete is then poured into the interior openings of the blocks. Other presently available foam blocks interlock with other blocks to form a single large cavity that is filled by concrete. While many of these foam block ICF systems have met with some level of success, there are also a number of shortcomings. Challenges arise in creating the foam blocks, effectively fitting them together to form a secure wall, pouring concrete into the blocks, and applying finishing materials. Many of these issues arise because of the unique properties of polystyrene (widely used in most ICFs), which responds and acts differently than more familiar building materials. In view of these and other issues, Applicant has recognized that improvements to insulating concrete forms is desirable.

Providing low cost housing and energy efficient buildings is in continue evolution, and still most of the new housing and small building construction is done with wood framing, build on site. Modular factory build units are now starting to be a tangible factor in the hole industry. New construction systems are in need. they need to be cost effective and comply with evolving energy requirements.

The objective of the present invention is to provide users with energy efficient, low cost ease to use environmental friendly in many ways construction system while solving a common problem in many ICF's products thru the use of aligning wedges that provide structural support for drywall and trim installation. The main purpose is to create a long lasting building system, structurally stronger and better insulated that a standard 2×6 or 2×8 frame wall. We created the lowest construction system delivering a cost effective structurally superior product that will only get stronger with the pass of time.

BRIEF DESCRIPTION OF THE DRAWINGS

Some of the embodiments will be described in detail, with reference to the following figures, wherein like designations denote like members, wherein.

Figure 1:
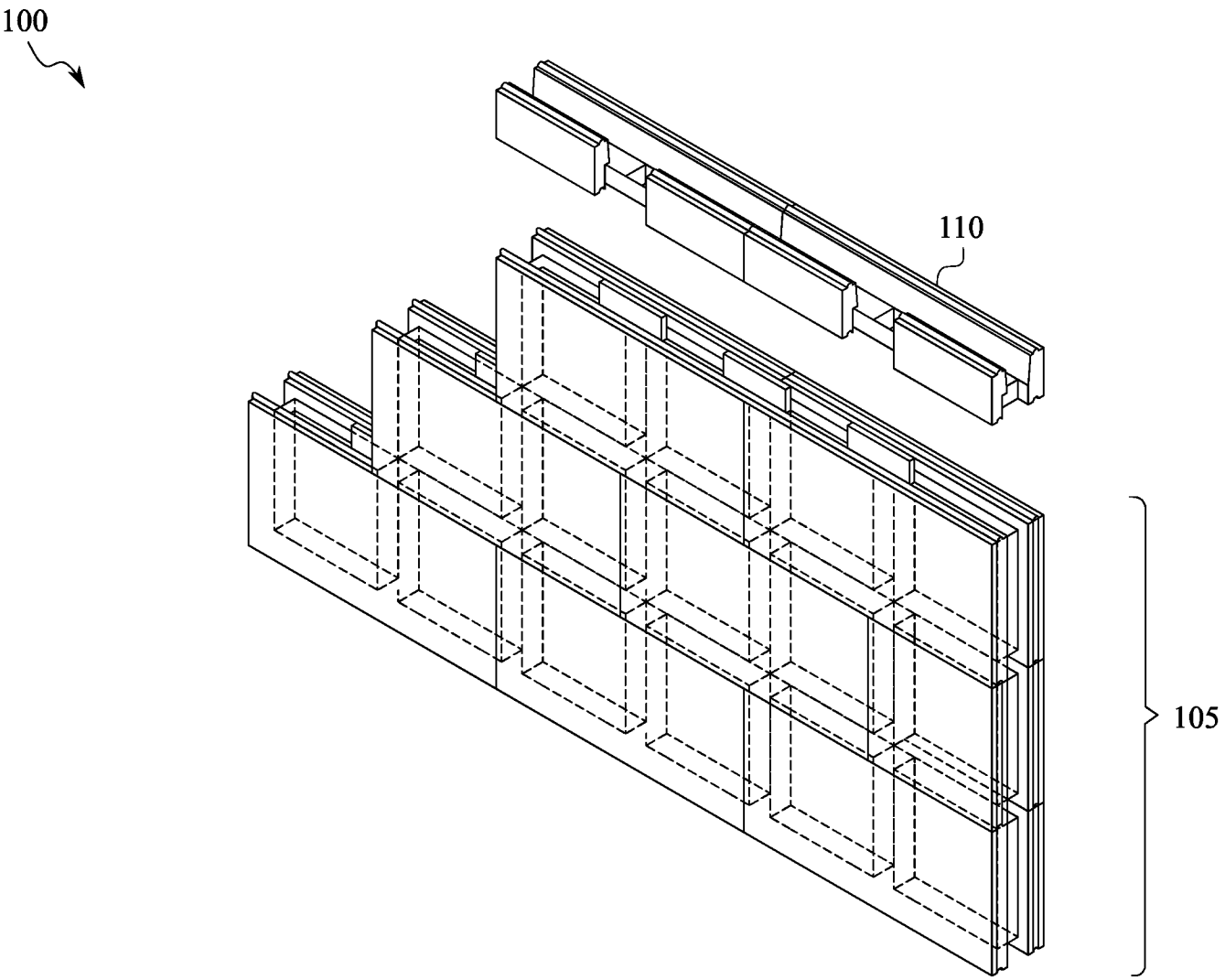
FIG. 1 depicts an exploded top perspective view of a modular superblock assembly according to some embodiments.

Unless otherwise specifically noted, articles depicted in the drawings are not necessarily drawn to scale.

DETAIL DESCRIPTIONS OF THE INVENTION

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

Other technical advantages may become readily apparent to one of ordinary skill in the art after review of the following figures and description. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise indicated, the drawings are intended to be read together with the specification and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate. As used herein, the term "dorsal" refers to positions that are located near, on, or towards the upper or top side of a structure.

The present disclosure includes many aspects and features. Moreover, while many aspects and features relate to, and are described in the context of insulating superblocks for constructing modular superblock assemblies, embodiments of the present disclosure are not limited to use only in this context.

Post and beam (interlinked vertical and horizontal supports) construction has been used for centuries in building construction and is known for its strength and longevity. Post and beam construction is one of the ancient methods of building and was used in Rome thousands of years ago. To be sure, post and beam construction is currently used today. Timbers can be employed to erect post and beam support structures. Concrete forms can also be employed to erect concrete post and beam support structures.

Nearly half a century ago, petroleum derivative foam began to be used for insulation purposes in residential and commercial buildings. Often this foam was only sprayed inside the walls or under the roof for an additional measure of protection. As the use of this foam increased, insulating concrete forms (hereinafter referred to as "ICFs") were introduced. Currently, there are numerous varieties of methods, designs and types of petroleum derived ICFs that have evolved for building purposes. Unlike wood or steel forms, the ICFs becomes a permanent part of the building, providing insulation that contributes to energy efficiency, decreased noise, and a smaller environmental footprint overall.

Generally, presently available ICFs include interlockable modular units, such as foam blocks, made of polystyrene beads that are poured into a mold and are fused together by the use of steam. These foam blocks generally are largely hollow with cavities that allow for columns of concrete to be poured inside them. The blocks are stacked to create a wall, and concrete is then poured into the interior openings of the blocks. Other presently available foam blocks interlock with other blocks to form a single large cavity that is filled by concrete.

While many of these foam block ICF systems have met with some level of success, there are also a number of shortcomings. Challenges arise in creating the foam blocks, effectively fitting them together to form a secure wall, pouring concrete into the blocks, and applying finishing materials. Many of these issues arise because of the unique properties of polystyrene (widely used in most ICFs), which responds and acts differently than more familiar building materials. In view of these and other issues, Applicant has recognized that improvements to insulating concrete forms is desirable.

The instant disclosure seeks to provide an environmentally friendly and economical complete building system that includes a series of interconnectable and stackable ICFs that are each locked and aligned by aligning features (e.g., aligning plates and aligning slots). The aligning features also serve as mounting points for attaching drywall as well as other paneling, trim work, cabinets, and/or similar structures. Each interconnectable and stackable ICF includes recesses that are configured to receive a minimum amount of reinforced concrete and hence are strong enough to meet or exceed the structural integrity of 2 in.×4 in. or 2 in.×6 in frame construction.

FIG. 1 is an exploded top perspective view of a modular superblock assembly 100 according to some embodiments. The modular superblock assembly 100 includes a plurality of interconnectable and stackable ICF 105 that each comprise a block body 305. The modular superblock assembly 100 includes a plurality of ceiling mounting blocks 110 positioned on the plurality of interconnectable and stackable ICF 105, in accordance with preferred embodiments. The plurality of ICF 105 are used to quickly and conveniently construct the modular superblock assembly 100, which can be used as part of a building structure. The superblock assembly 100 can be configured to support the weight of one or more platforms (e.g., ceilings and/or floors of a building structure). To be sure, the plurality of interconnectable and stackable ICF 105 are preferably held together via steel rebar and poured concrete, which require that the ICF 105 are preferably staggeredly positioned on top of each other in a manner that allow aligning features to coincide.

Figure 2:
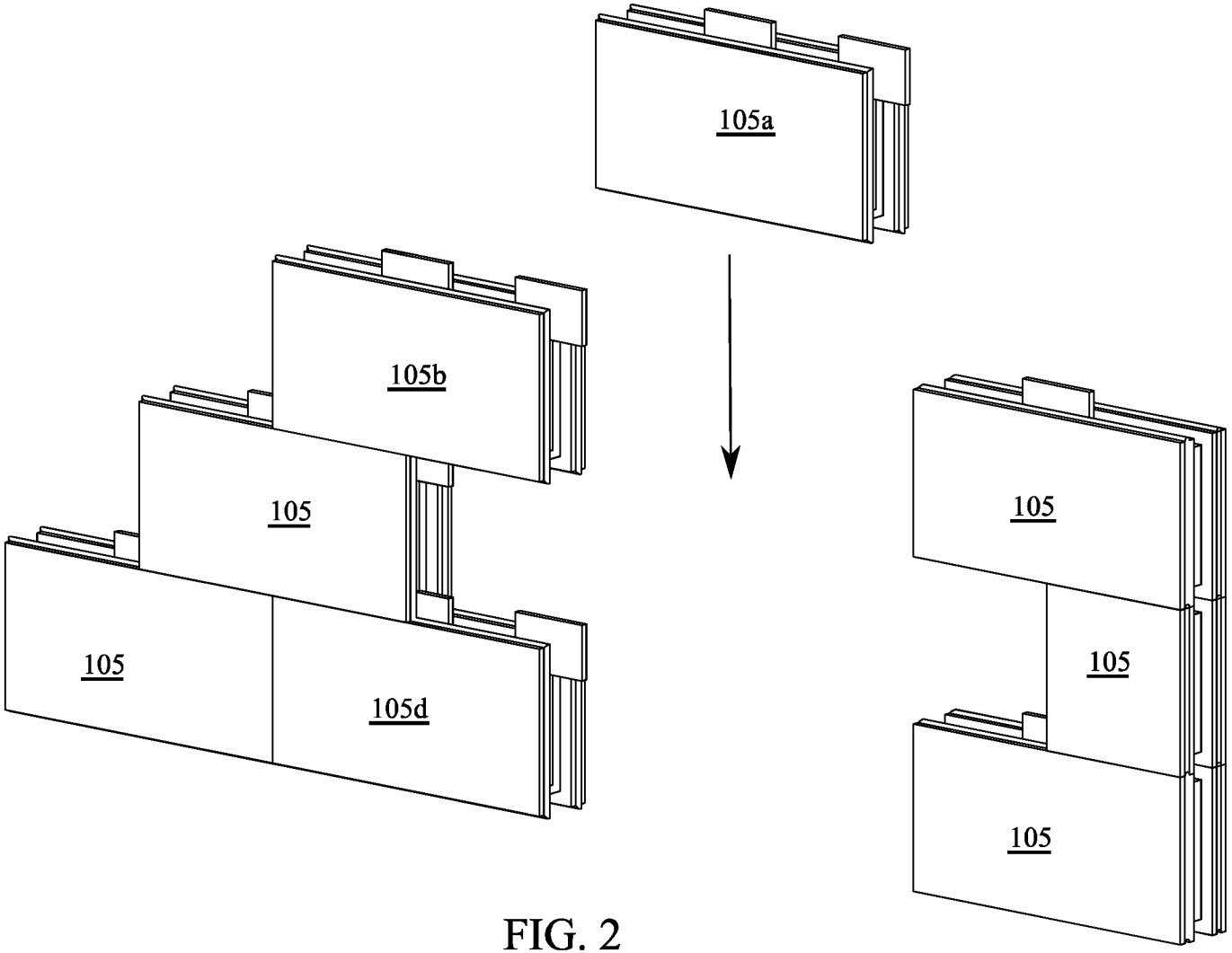
FIG. 2 depicts an exploded view of the modular superblock assembly illustrating the connections between individual insulated concrete forms, according to other embodiments.

The ICF 105 is preferably a solid structure that is formed using a polymer concrete composite. The interconnectable and stackable ICF 105 is a structure that includes a block body 305. As depicted in FIG. 2, the block body 305 preferably includes a central mounting hole 310, a first lateral recess 315, a second lateral recess 320, a first vertical recess 325, a second vertical recess 330, and a plurality of aligning features. The central mounting hole 310 is equidistantly positioned between the first vertical recess 325 and the second vertical recess 330, according to preferred embodiments.

Figure 3:
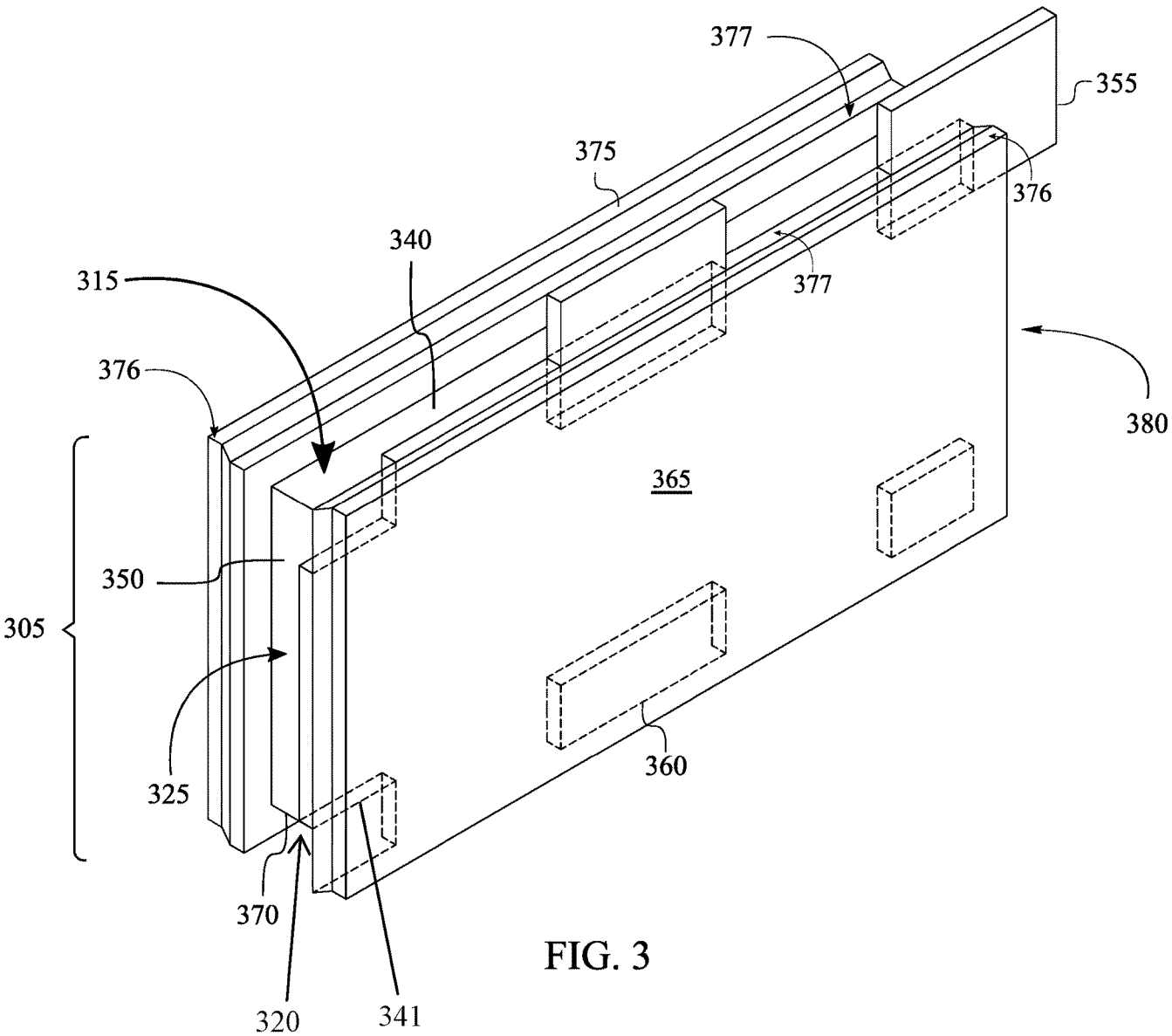
FIG. 3 depicts a perspective view of an insulating concrete forms, according to certain embodiments.

FIG. 3 depicts a top perspective view of the ICF 105, according to certain embodiments. In this particular embodiment, the central mounting hole 310 is oriented parallel to the first vertical side 350 and the second vertical side 380. The first lateral recess 315 preferably traverses a first lateral side 340 of the block body 305. The second lateral recess 320 traverses a second lateral side 341 of the block body 305. The first vertical recess 325 traverses a first vertical side 350 of the block body 305.

The second vertical recess 330 traverses a second vertical side 380 of the block body 305. The central mounting hole 310 traverses both the first lateral recess 315 and the second lateral recess 320. The second lateral recess 320 preferably traverses second lateral side 341 of the block body 305.

The second vertical recess 330 traverses the second vertical side 380 of the block body 305.

The central mounting hole 310 is oriented perpendicular to both the first lateral recess 315 and the second lateral recess 320. The plurality of aligning features comprises aligning plates 355 and aligning slots 360. Each aligning plate is partially embedded in the first lateral side 340 of the block body 305 and positioned proximate to the first lateral recess 315. The aligning plates 355 are each adjacently positioned between the middle block section 370 and first block section 365. Each aligning slot 360 is positioned on the first surface 805 proximate to the second lateral recess 320 and opposite the aligning plates 355. The aligning slots 360 are each adjacently positioned between the middle block section 370 and first block section 365 opposite the aligning plates 355. When stacked, the aligning plate 355 of an ICF 105 engages the aligning slot 360 of the ICF 105 positioned thereon.

The block body 305 includes a first block section 365, a middle block section 370, and a second block section 375. The middle block section 370 is positioned between the first block section 365 and the second block section 375 and thereby forms the first lateral recess 315, a second lateral recess 320, a first vertical recess 325, and a second vertical recess 330. The middle block section 370 is substantially parallelepiped. The central mounting hole 310 traverses the middle block section 370. The first block section 365 and the second block section 375 each include a first segment 376 and a second segment 377. The first segment 376 and the second segment 377 each extend beyond the middle block section 370 and are positioned adjacent to each other. The first segment 376 and the second segment 377 are in a vertically staggered relationship with each other.

The first segment 376 is positioned above the second segment 377 and the second segment 377 is positioned adjacent to the middle block section 370. To be sure, the staggered relationship of the first segment 376 and the second segment 377 functions as an additional alignment feature when one ICF 105 is vertically stacked on the other.

When stacked laterally, the first vertical recess 325 of one ICF 105 and the second vertical recess 330 of the adjacent ICF 105 forms a vertical hollow within which concrete can be pouted and/or steel rebar can be positioned. Similarly, when stacked vertically, the first lateral recess 315 of one ICF 105 and the second lateral recess 320 of the adjacent ICF 105 forms a horizontal hollow within which concrete can be poured. In some embodiments, polyurethane dots can be positioned between the plurality of ICF 105 to temporarily hold the resulting structure together prior to addition of concrete and rebar. The cured concrete provides the structural support of the modular superblock assembly 100 when assembled.

Figure 4:
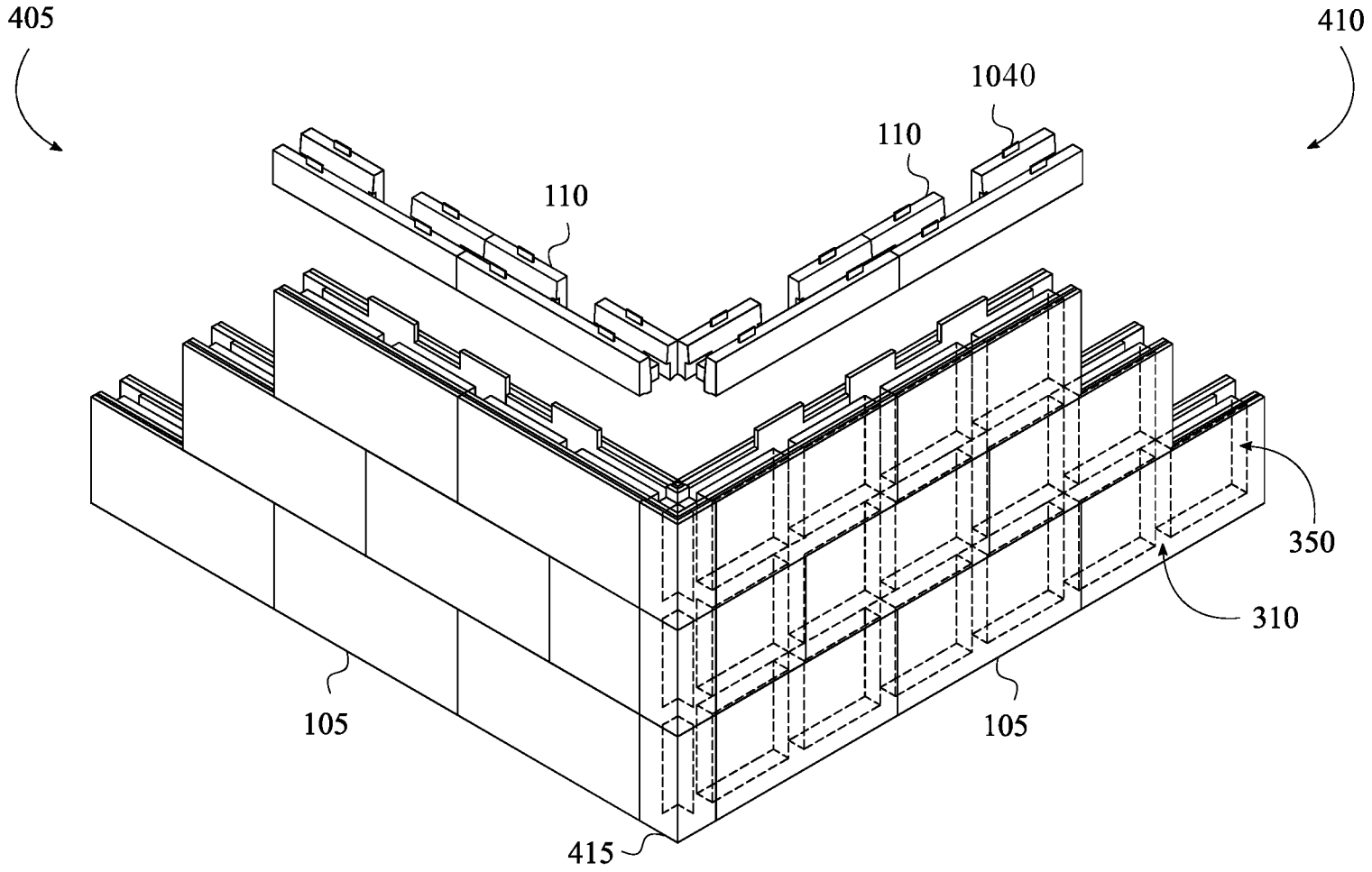
FIG. 4 depicts a rear view of a superblock assembly, according to yet still other embodiments.
Figure 5:
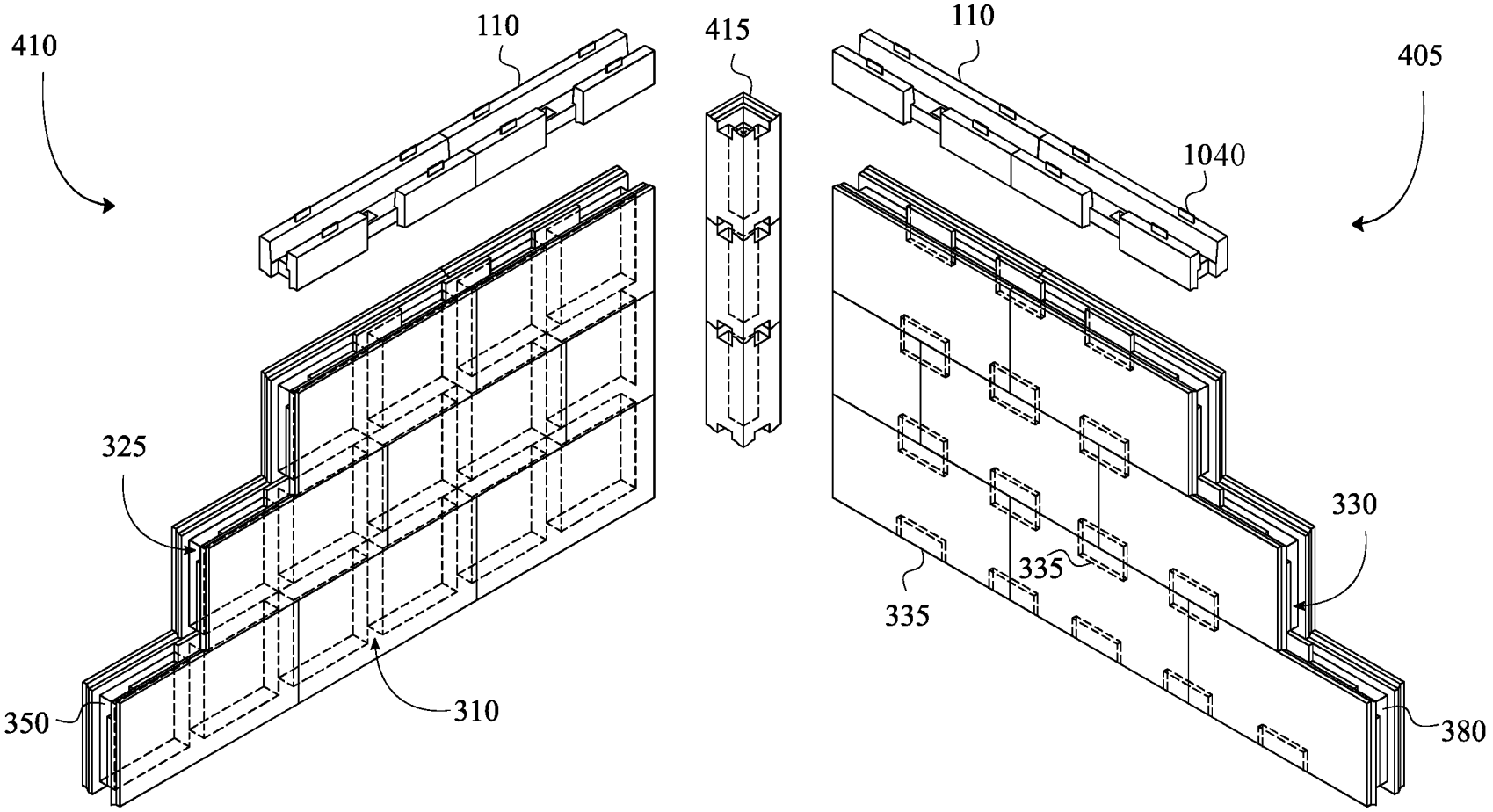
FIG. 5 depicts a front exploded view of superblock assembly, according to some embodiments.
Figure 6:
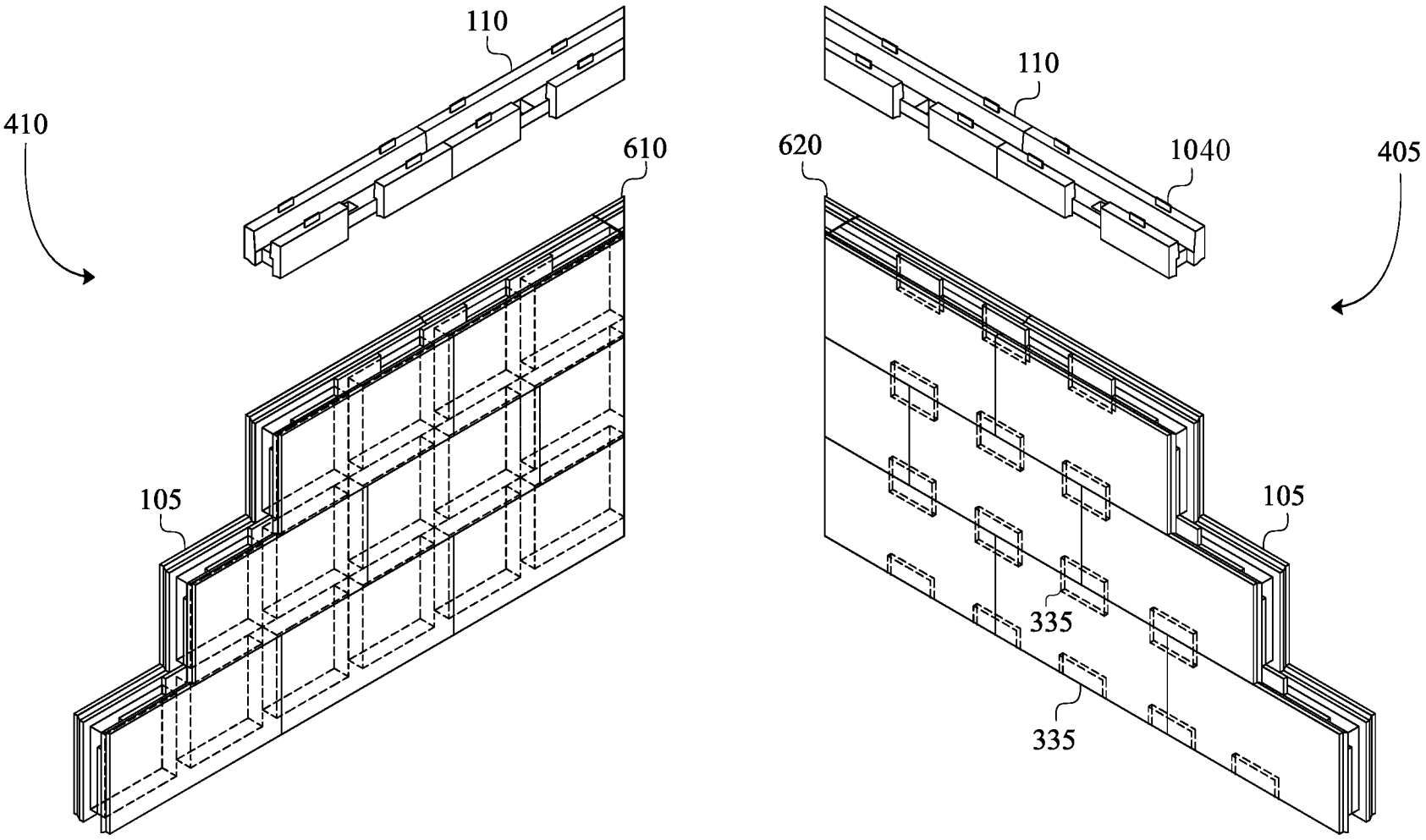
FIG. 6 depicts a front exploded view of the first wall structure coupled to the second wall structure via the corner blocks according to other embodiments.
Figure 7:
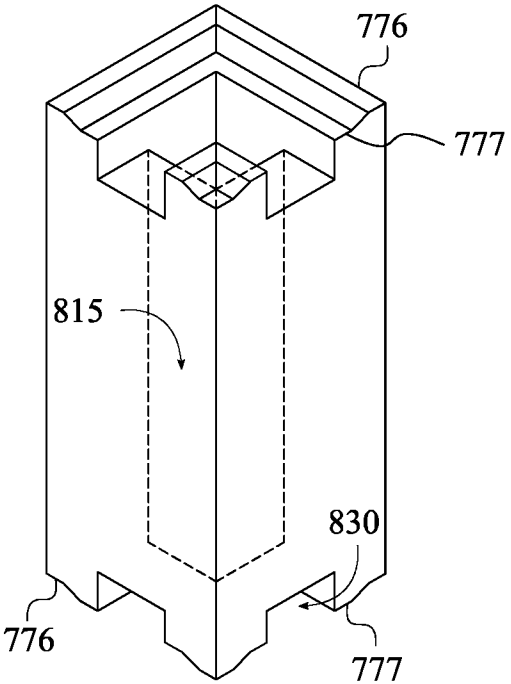
FIG. 7 depicts a perspective view of a corner block, according to certain embodiments.
Figure 8:
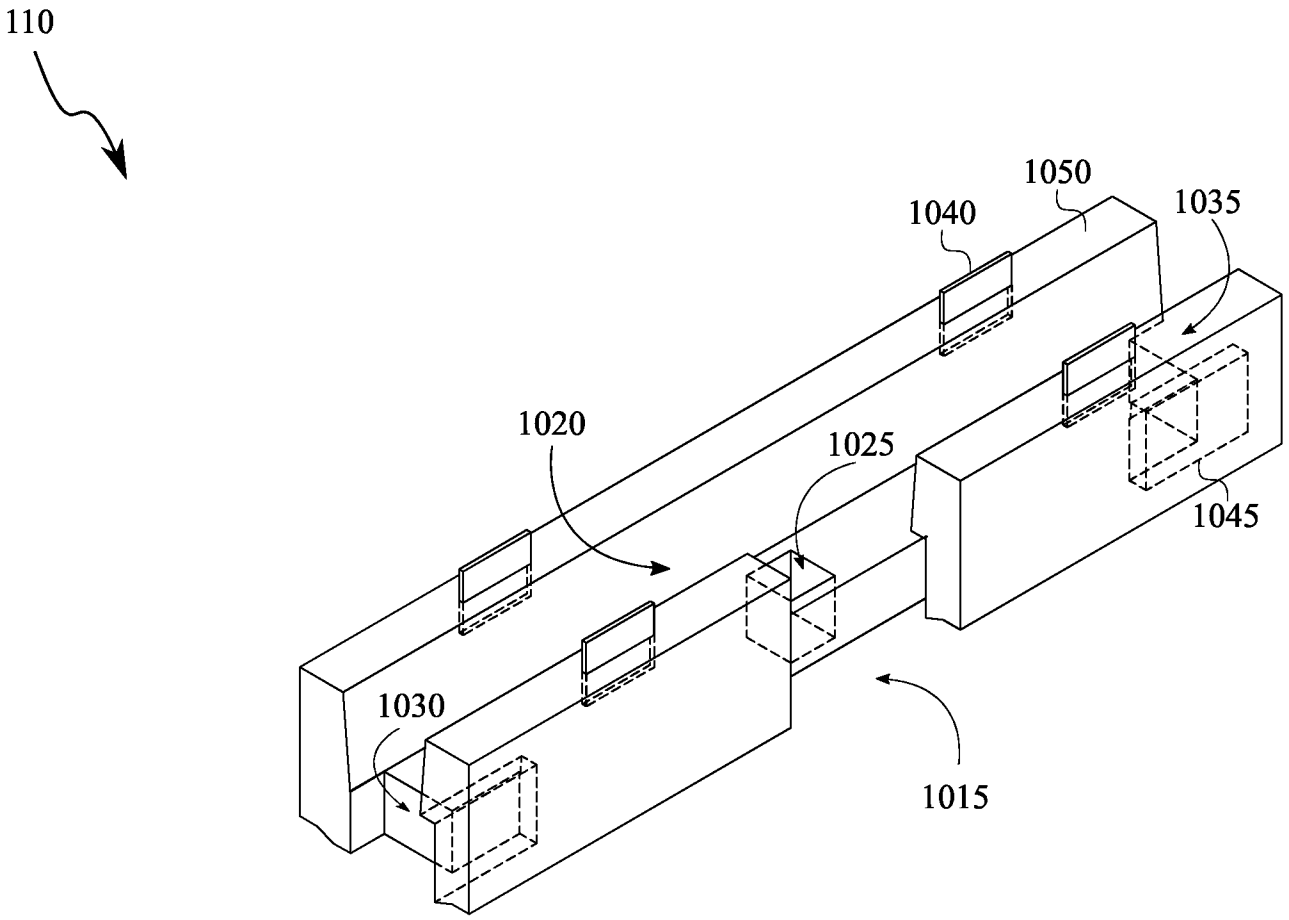
FIG. 8 depicts a perspective view of a ceiling mounting block, according to yet still other embodiments.

FIGS. 4-6 depicts perspective views of a superblock assembly 400, according to certain embodiments. The super block assembly 400 includes a plurality of the interconnectable and stackable insulating concrete form 105 that together form a first wall assembly 405 and a second wall assembly 410 interconnected via a corner block 415. The first wall assembly 405 is oriented at an angle relative to the second wall assembly 410. As depicted in FIG. 8, the corner block 415 preferably includes a first surface 805, a second surface 810, and a central orifice 815. The first surface 805 is positioned opposite the second surface 810. The central orifice 815 extends from the first surface 805 to the second surface 810.

The first surface 805 preferably includes a first L-recess 820 that aligns with the first lateral recess 315. The second surface 810 preferably includes a second L-recess 830 that aligns with the second lateral recess 320.

FIG. 6 depicts a front exploded view of the first wall assembly 405 and the second wall assembly 410 coupled to a first wedge section 610 and a second wedge section 620, respectively, according to certain embodiments. The corner block 415 includes a first wedge section 610 and a second wedge section 620 positioned adjacent thereto. The first wedge section 610 is positioned adjacent to the first wall assembly 405. Similarly, the second wedge section 620 is positioned adjacent to the second wall assembly 410. The first wedge section 610 includes a plurality of serially positioned wedge sections. The second wedge section 620 include a plurality of serially positioned wedge sections. The first wedge section 610 can be oriented at any angle relative to the second wedge section 620 (e.g., 90°, 60°, 45°, or similar orientation).

FIG. 8 is a perspective view of a ceiling mounting block 110, according to other embodiments. Each ceiling mounting block 110 includes a ceiling mounting slot 1020, a central cavity 1025, a first lateral cavity 1030, a second lateral cavity 1035, a plurality of ceiling-supporting protrusions 1040, and a plurality of block-mounting slots 1045. The ceiling mounting slot 1020 preferably traverse the ceiling-mounting block 110 from an upward-facing side 1050 of the ceiling-mounting block 110. According to preferred embodiments, the edge of the platform 1010 (further discussed below) is oriented at a 90-degree angle. As such, edge of the platform 1010 is preferably inserted into the ceiling mounting slot 1020.

Figure 9:
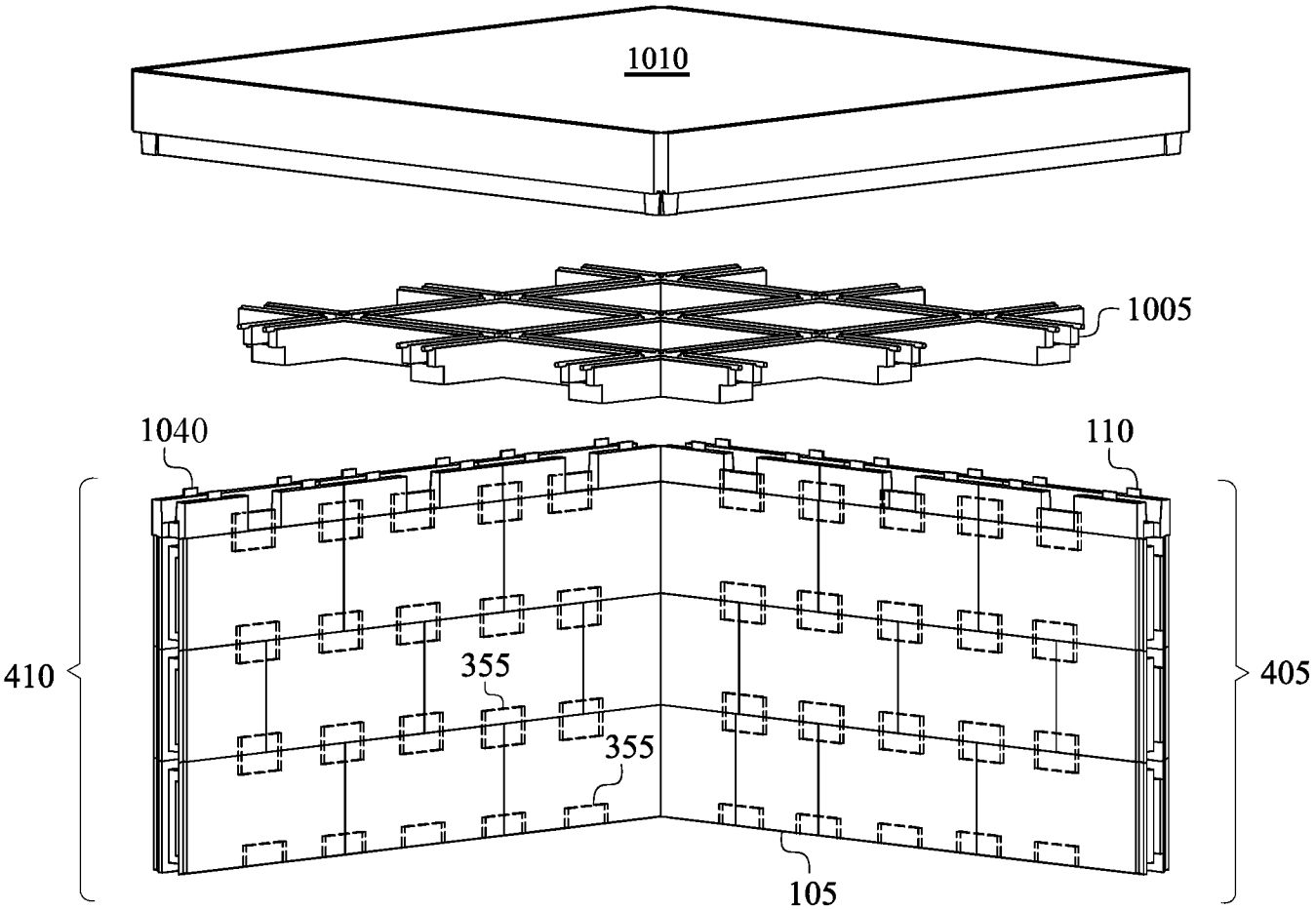
FIG. 9 depicts an exploded view a platform, ceiling joist, and wall structures, according to some embodiments.

FIG. 9 depicts a perspective exploded view of a platform 1010 mounted on the superblock assembly 400, according to other embodiments. As discussed above, the superblock assembly 400 includes the first wall assembly 405 and the second wall assembly. Here, a plurality of ceiling mounting blocks 110 are positioned on top of both the first wall assembly 405 and the second wall assembly 410. A ceiling joist 1005 is positioned on the plurality of ceiling mounting blocks 110 and a platform 1010 is positioned on the ceiling joist 1005.

Figure 10:
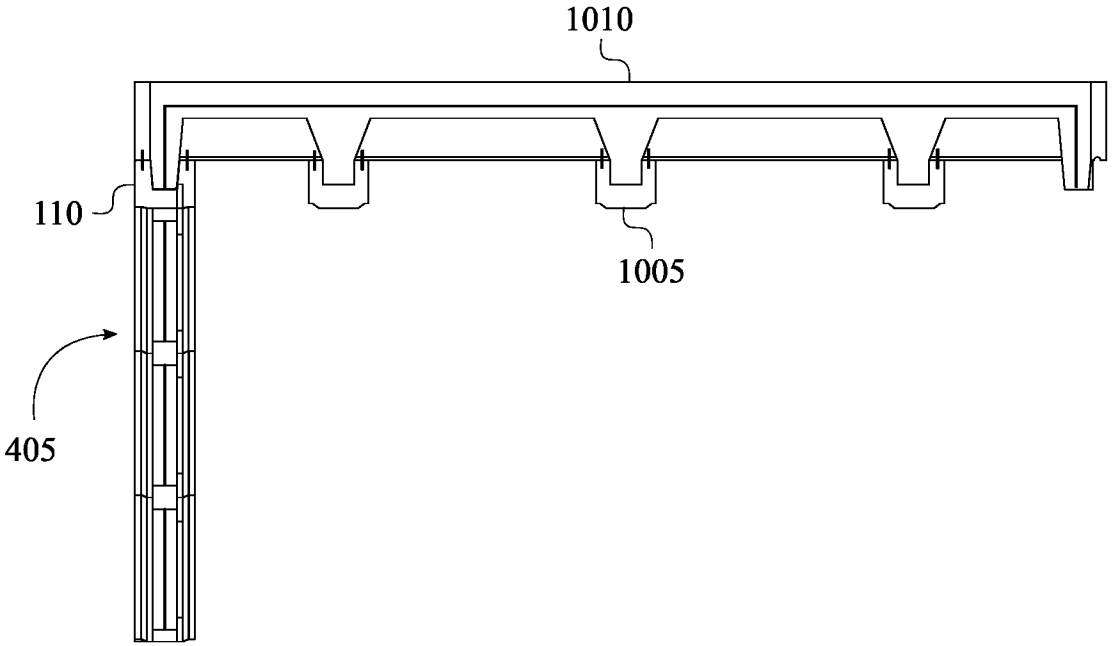
FIG. 10 depicts the platform positioned on the wall structure, according to other embodiments.

Each ceiling mount block preferably includes a centrally positioned ceiling-joist slot 1015 and a ceiling mounting slot 1020 that longitudinally traverses the ceiling mounting block 110. The ceiling joist 1005 is preferably positioned in the ceiling joist slot 1015 of each of the ceiling mount blocks 110. In other words, the ceiling joist 1005 engages the ceiling joist slot 1015 of each ceiling mount block 110 when positioned therein, as depicted in FIG. 10. The platform 1010 is preferably positioned on the ceiling mounting slot 1020. Similarly, the platform 1010 engages the ceiling mounting slot 1020.

Although the disclosure has been explained in relation to its preferred embodiment, it is to be understood that many other possible modifications and variations can be made without departing from the spirit and scope of the disclosure.

The invention claimed is:

1. A modular superblock assembly comprising:

a plurality of interconnectable and stackable insulating concrete forms;

each of the plurality of interconnectable and stackable insulating concrete forms comprising a block body, the block body comprising a central mounting hole, a first lateral recess, a second lateral recess, a first vertical recess, a second vertical recess, a plurality of aligning plates, a plurality of aligning slots, a first lateral side, a second lateral side, a first vertical side, a second vertical side, a first surface, a first block section, a middle block section and a second block section, the first lateral recess traversing the first lateral side, the second lateral recess traversing the second lateral side, the first vertical recess traversing the first vertical side, the second vertical recess traversing the second vertical side, the central mounting hole traversing the first lateral recess and the second lateral recess, the central mounting hole being oriented perpendicular to the first lateral recess and the second lateral recess, each of the plurality of aligning plates being partially embedded in the first lateral side and positioned proximate to the first lateral recess, the plurality of aligning slots being positioned on the first surface proximate to the second lateral recess and opposite the plurality of aligning plates, the central mounting hole being equidistantly positioned between the first vertical recess and the second vertical recess, the central mounting hole being oriented parallel to the first vertical side and the second vertical side, the middle block section being positioned between the first block section and the second block section and thereby forming the first lateral recess, the second lateral recess, the first vertical recess and the second vertical recess, the middle block section being substantially parallelepiped, the central mounting hole traversing the middle block section from the first lateral recess to the second lateral recess, the first block section and the second block section each comprising a first segment and a second segment, the first segment and the second segment of the first block section extending beyond the middle block section, the first segment and the second segment of the second block section extending beyond the middle block section, the first segment and the second segment of the first block section being positioned adjacent to each other, the first segment and the second segment of the second block section being positioned adjacent to each other, the first segment and the second segment of the first block section being not vertically aligned with each other, the first segment and the second segment of the second block section being not vertically aligned with each other, the first segment of the first block section being positioned above the second segment of the first block section, the first segment of the second block section being positioned above the second segment of the second block section, the second segment of the first block section being positioned adjacent to the middle block section, the second segment of the second block section being positioned adjacent to the middle block section, the plurality of aligning plates being adjacently positioned between the middle block section and first block section, the plurality of aligning slots being adjacently positioned between the middle block section and first block section opposite the plurality of aligning plates;

each of the plurality of interconnectable and stackable insulating concrete forms being a solid structure that comprises a polymer concrete;

the plurality of interconnectable and stackable insulating concrete forms forming a first wall assembly and a second wall assembly;

the first wall assembly being oriented at an angle relative to the second wall assembly;

a plurality of corner blocks;

the first wall assembly and the second wall assembly being interconnected via the plurality of corner blocks;

each of the plurality of corner blocks comprising a first block surface, a second block surface and a central orifice, the first block surface being positioned opposite the second block surface, the central orifice extending from the first block surface to the second block surface, the first block surface comprising a first L-recess, the second block surface comprising a second L-recess;

a corresponding first L-recess being aligned with the first lateral recess of the block body of a corresponding interconnectable and stackable insulating concrete form;

a corresponding second L-recess being aligned with the second lateral recess of the block body of another corresponding interconnectable and stackable insulating concrete form;

a plurality of ceiling mounting blocks;

the plurality of ceiling mounting blocks being positioned on top of both the first wall assembly and the second wall assembly;

a ceiling joist;

the ceiling joist being positioned on the plurality of ceiling mounting blocks;

a platform;

the platform being positioned on the ceiling joist; and each of the plurality of ceiling mounting block comprising a centrally positioned ceiling-joist slot and a longitudinal ceiling mounting slot, the ceiling joist being positioned in the centrally positioned ceiling joist slot, the platform being positioned on the longitudinal ceiling mounting slot.

* * * * *